US007742731B2

(12) United States Patent
Shinkawa et al.

(10) Patent No.: US 7,742,731 B2
(45) Date of Patent: Jun. 22, 2010

(54) ROLLER DRIVE CONTROL METHOD FOR FIXING APPARATUS

(75) Inventors: Tatsuya Shinkawa, Nara (JP); Kimihide Tsukamoto, Osaka (JP); Kan Mukai, Nara (JP); Takashi Yamanaka, Nara (JP); Kenichi Isomi, Nara (JP); Yasuhiro Takai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 89 days.

(21) Appl. No.: 11/943,620

(22) Filed: Nov. 21, 2007

(65) Prior Publication Data

US 2008/0124143 A1 May 29, 2008

(30) Foreign Application Priority Data

Nov. 27, 2006 (JP) ..... 2006-318764

(51) Int. Cl.
*G03G 15/20* (2006.01)

(52) U.S. Cl. ..... 399/327; 399/67; 399/323

(58) Field of Classification Search ..... 399/67, 399/70, 71, 122, 123, 322, 323, 326, 327; 219/216

See application file for complete search history.

(56) References Cited

U.S. PATENT DOCUMENTS 3,706,491 A * 12/1972 Furman et al. ..... 355/133
5,142,340 A * 8/1992 Farrell et al. ..... 399/327
6,094,559 A * 7/2000 Otsuka et al. ..... 399/327
6,181,890 B1 * 1/2001 Kataoka et al. ..... 399/67
2002/0136572 A1 * 9/2002 Kaji et al. ..... 399/327
2003/0002894 A1 * 1/2003 Satoh ..... 399/324
2003/0210934 A1 * 11/2003 Matsumoto ..... 399/324

FOREIGN PATENT DOCUMENTS

| | | |
|---|---|---|
| JP | 04-282675 | 10/1992 |
| JP | 10-307503 | 11/1998 |
| JP | 2000-047533 | 2/2000 |
| JP | 2000-147930 | 5/2000 |
| JP | 2002-244473 | 8/2002 |
| JP | 2005-099426 | 4/2005 |
| JP | 2006-044836 | 2/2006 |

* cited by examiner

*Primary Examiner*—David P Porta
*Assistant Examiner*—Benjamin Schmitt
(74) *Attorney, Agent, or Firm*—Renner, Otto, Boisselle & Sklar, LLP

(57) ABSTRACT

One embodiment of the present invention involves a roller drive control method for a fixing apparatus in which a separation claw for separating a recording paper and a cleaning unit for removing toner that has become residual on a surface of a heat roller are arranged near a surface of the heat roller that fixes toner onto the recording paper, wherein a predetermined period different from a fixing process period in which fixing of toner onto the recording paper is carried out is set as a toner removal period for removing toner that has adhered to the separation claw, and the heat roller is rotationally driven so that the rotation velocity of the heat roller is different in the fixing process period and the toner removal period.

13 Claims, 9 Drawing Sheets

FIG.9

Table 1 (when fixing roller is rotated continuously)

| peripheral rotation velocity of hot roller (mm/sec.) | evaluation of smearing |
|---|---|
| 540 | ××× |
| 178 | ×× |
| 128 | × |
| 85 | △~× |
| 57 | △ |
| 42 | ○ |
| 28 | ◎ |

FIG.10

Table 2 (when fixing roller is rotated intermittently)

| peripheral rotation velocity of hot roller (mm/sec.) | on time (msec.) | off time (msec.) | number of repetitions of on-off | evaluation of smearing |
|---|---|---|---|---|
| 110 | 20 | 100 | 70 | × |
| 44 | 20 | 200 | 70 | ○~△ |
| 55 | 20 | 500 | 70 | ○~△ |
| 147 | 30 | 100 | 70 | ×× |
| 95 | 30 | 200 | 50 | △ |
| 114 | 30 | 500 | 50 | × |
| 134 | 50 | 500 | 50 | ×× |
| 183 | 50 | 700 | 30 | ××× |
| 557 | continuous rotation | | | ××× |

ROLLER DRIVE CONTROL METHOD FOR FIXING APPARATUS

BACKGROUND OF THE INVENTION

This application claims priority under 35 U.S.C. §119(a) on Patent Application No. 2006-318764 filed in Japan on Nov. 27, 2006, the entire contents of which are hereby incorporated by reference.

The present invention relates to roller drive control methods of fixing apparatuses in electrophotographic image forming apparatuses.

These image forming apparatuses are provided with fixing apparatuses that melt and firmly fix unfixed toner onto a recording paper. In this type of fixing apparatus, a thermal fixing roller system is often used in which, while the recording paper is sandwiched and transported in a pressing area (nip region) between a heat roller and a pressure roller, the recording paper is subjected to heat and pressure by the heat roller and the pressure roller so that toner on the recording paper is thermally melted and fixed there.

In these thermal fixing roller system fixing apparatuses, the peripheral rotation velocity of the heat roller is generally controlled at a velocity of 1.005 to 1.03 times the print processing speed of the image forming apparatus. This velocity is a velocity for keeping the recording paper that enters the pressing area from being detained in the pressing area and is a velocity for eliminating the delay of nipping when the leading edge of the recording paper that is entering impacts against the pressing area.

On the other hand, not all the toner that is melted in the pressing area becomes firmly fixed onto the paper after passing through the pressing area, and a portion thereof is rotated while adhering to the heat roller, which then smears surfaces of components such as a separation claw for the recording paper that is in contact with the heat roller, a detection sensor for detecting a surface temperature of the heat roller, and the pressure roller. To eliminate such smearing in conventional fixing apparatuses, a cleaning unit for cleaning toner that has adhered to the surface of the heat roller is arranged downstream from the pressing area on an outer circumferential surface of the heat roller and downstream from the separation claw. The cleaning unit is provided with a cleaning member, such as a web sheet for example, that presses against the heat roller with a predetermined pressure and carries out collection of toner that adheres to the web sheet and cleaning of the heat roller.

However, as mentioned above, the separation claw is arranged on a downstream side of the pressing area and on an upstream side of the cleaning unit, and therefore under existing circumstances it is not possible to clean the toner that adheres to the separation claw.

Ordinarily, when the print processing speed is slow, the number of sheets processed per hour is small and the amount of toner that adheres to the separation claw is also small. Thus, when the toner that is in a melted state adhering onto the separation claw is moved in reverse to the heat roller and is transported, the cleaning capability of the cleaning member (web sheet) of the cleaning unit is sufficient to enable cleaning of the toner that has been subjected to reverse movement.

However, the print processing speeds of image forming apparatuses have increased in recent years, and conventional speeds of approximately 300 to 400 mm/sec have now become 500 to 700 mm/sec, thereby achieving high speed processing in which the number of sheets processed per unit of time is from 100 to 120 sheets per minute. Along with this, image forming apparatuses have also become more multifunctional, and developments in color print processing have also advanced as a part of this. For this reason, there has been a tendency for the amount of toner that adheres to the heat roller to increase from year to year and along with this the amount of toner that adheres to the separation claw is also increasing. And when the amount of toner that adheres to the separation claw increases, the amount of toner that re-adheres to the heat roller after the above-mentioned reverse movement also increases, and therefore the cleaning capability of the web sheet, which is the cleaning member of the cleaning unit, is undesirably exceeded, and this poor cleaning becomes a cause of smearing of other components (such as the detection sensor that detects the surface temperature of the heat roller as well as the pressure roller).

In order to address this problem, in JP H10-307503A, instead of a cleaning member such as a rubber blade or a felt cloth that are used in conventional fixing apparatuses, a web cleaning apparatus is disclosed in which a continually new cleaning region can be selected and, moreover, the contact surface area on the heat roller can also be set as desired.

In the web cleaning apparatus described in JP H10-307503A, the contact region between the heat roller and the cleaning web (web sheet) of the cleaning member is fixed, and also the web sheet itself is thin (ordinarily a cloth having a thickness of several tens to 150 μm is used) and therefore increases in the pressing force at the contact region cannot be expected. For this reason, there is a problem in that when a large amount of toner subjected to reverse movement from the separation claw to the heat roller as described above is transported in, there is a possibility of an occurrence of adhered toner escaping through the pressing area (nip region) at the heat roller.

SUMMARY OF THE INVENTION

The present invention been devised in order to address this problem and it is an object therein to provide a roller drive control method for a fixing apparatus aimed at reducing adhered toner that escapes past a cleaning member by varying a rotation velocity of a heat roller and a pressure roller between a rotation velocity of a time of a fixing process step (when a recording paper is passing through a nip region) and of a time other than the fixing process step (when a recording paper is not passing through the nip region), and aimed at improving the cleaning efficiency of a cleaning unit for adhered toner.

In order to address this problem, a roller drive control method for a fixing apparatus according to the present invention is provided in which a separation claw for separating a recording paper and a cleaning unit for removing toner that has become residual on a surface of a heat roller are arranged near a surface of the heat roller that fixes toner onto the recording paper, wherein a predetermined period different from a fixing process period in which fixing of toner onto the recording paper is carried out is set as a toner removal period for removing toner that has adhered to the separation claw, and the heat roller is rotationally driven so that the rotation velocity of the heat roller is different in the fixing process period and the toner removal period.

That is, a rotation velocity of the heat roller is set to a low speed in the toner removal period. To describe this more specifically, a peripheral rotation velocity of the heat roller in the fixing process period is a slightly faster velocity than a print processing velocity of an image forming apparatus (namely, 1.005 to 1.03 times faster than the printing process speed), and a peripheral rotation velocity of the heat roller in the toner removal period is a peripheral rotation velocity 1/19 to 1/10 times the peripheral velocity of the heat roller in the fixing process period. Here, a peripheral rotation velocity of 1/19 is a velocity of 28 mm/sec, and a peripheral rotation velocity of 1/10 is a velocity of 54 mm/sec. By setting the velocity in this manner, a longer period is achieved in which the cleaning member and the smeared portions on the heat roller are in contact, thereby enabling improved cleaning efficiency for toner that has adhered onto the heat roller. Thus, when the toner that is in a melted state adhering onto the separation claw is moved in reverse to the heat roller and is transported, it becomes possible to clean the toner that has moved in reverse from the separation claw. In this way, other components arranged in areas around the heat roller (such as the detection sensors for detecting the surface temperature of the heat roller, external heating devices, and the pressure roller and the like) can be kept from becoming smeared, thereby achieving improved fixing quality. It should be noted that it is possible to use a web sheet as the cleaning unit.

Furthermore, since a longer time can be achieved for contact between the cleaning member web sheet and the heat roller when the rotation velocity of the heat roller is made low speed, the pressing force (contact pressure) of the web sheet pressing onto the heat roller can be reduced, thereby achieving simplification in mechanical terms and also enabling reductions in abrasions that occur on the heat roller surface. Scratches to the surface of the heat roller occur when adhered residual toner at the contact region to the web sheet hardens when power to the fixing apparatus is stopped, and the hardened adhered toner rubs against the surface of the heat roller with a contact pressure when power is turned on again and rotationally driving of the heat roller recommences. Further still, since the contact pressure can be reduced, the web sheet used as the cleaning member does not deform at the contract region and does not suffer wrinkling or tearing or the like. In this way, a more stable cleaning capability can be achieved.

Furthermore, the toner removal period is set to a period in which the heat roller performs at least two rotations or more. That is, performing two rotations involves passing the pressing area at the cleaning unit two times, and residual toner that could not be fully removed the first time can be removed the second time. In this way, residual toner can be removed more reliably.

Furthermore, the toner removal period may be a period in which the heat roller performs four rotations. That is, when residual toner that could not be fully removed the first time passes the pressing area, it is possible to perform reverse movement on the pressure roller side, and adhered toner that has been moved in reverse to the pressure roller can again be moved in reverse to the heat roller when one rotation has been performed and it again passes through the nip region. In other words, at this point in time, the heat roller commences its third rotation and residual toner that has been moved in reverse from the pressure roller is removed by the cleaning unit. In this case, in consideration of an unlikely event that residual toner that has been moved in reverse cannot be removed, in the present invention the toner removal period continues for a further one rotation, thereby achieving more reliable removal of residual toner.

Here, a timing of a transition to the toner removal period in the above-described manner can be a timing by which a standby mode commences immediately after completion of print requests to the image forming apparatus. Furthermore, as a different timing of a transition to the toner removal period, it is possible to set a timing during a post-printing rotation process after a trailing edge of a final paper of print requests made to the image forming apparatus has passed through a pressing area between the heat roller and a pressure roller.

Further still, a timing of a transition to the toner removal period when print request jobs are made successively to the image forming apparatus can be set to an arbitrary timing during an idle rotation period between print request jobs made to the image forming apparatus or a period from commencement of a post-printing rotation process of a print request job until completion of a pre-printing rotation process of a next print request job.

By using timing such as these, it is possible to set the toner removal period without exerting an influence on the fixing process period.

It should be noted that after the toner removal period has finished, power to the heat roller is turned off by the image forming apparatus changing to a standby mode.

Furthermore, rotation velocity control of the heat roller is controlled by a magnitude of power given to a rotational drive source or by increasing/decreasing a number of pulses of power. That is, rotation control for high speed rotation [(print processing speed)×(1.005 to 1.03)] and low speed rotation is controlled by varying the input voltage to the rotational drive sources (DC motor, pulse motor) and varying the number of pulses, and therefore a mechanical structure for varying speed (such as a clutch, or a separate gear train for driving or the like) becomes unnecessary. For this reason, it is possible to achieve simplification of control, greater compactness of the fixing apparatus, and simplification of peripheral control including control portions.

BRIEF DESCRIPTION OF THE DRAWINGS

FIG. 9 is a table showing a summary of evaluation results of smearing when a heat roller is caused to rotate continuously at various peripheral rotation velocities.

FIG. 10 is a table showing a summary of evaluation results of smearing when the heat roller is caused to rotate at various peripheral rotation velocities and is intermittently rotated (the drive source being a pulse motor) with various on-off periods.

DESCRIPTION OF THE PREFERRED EMBODIMENTS

Hereinafter, an embodiment of the present invention is described in detail with reference to the accompanying drawings.

—Overall Description of Image Forming Apparatus—

Figure 1:
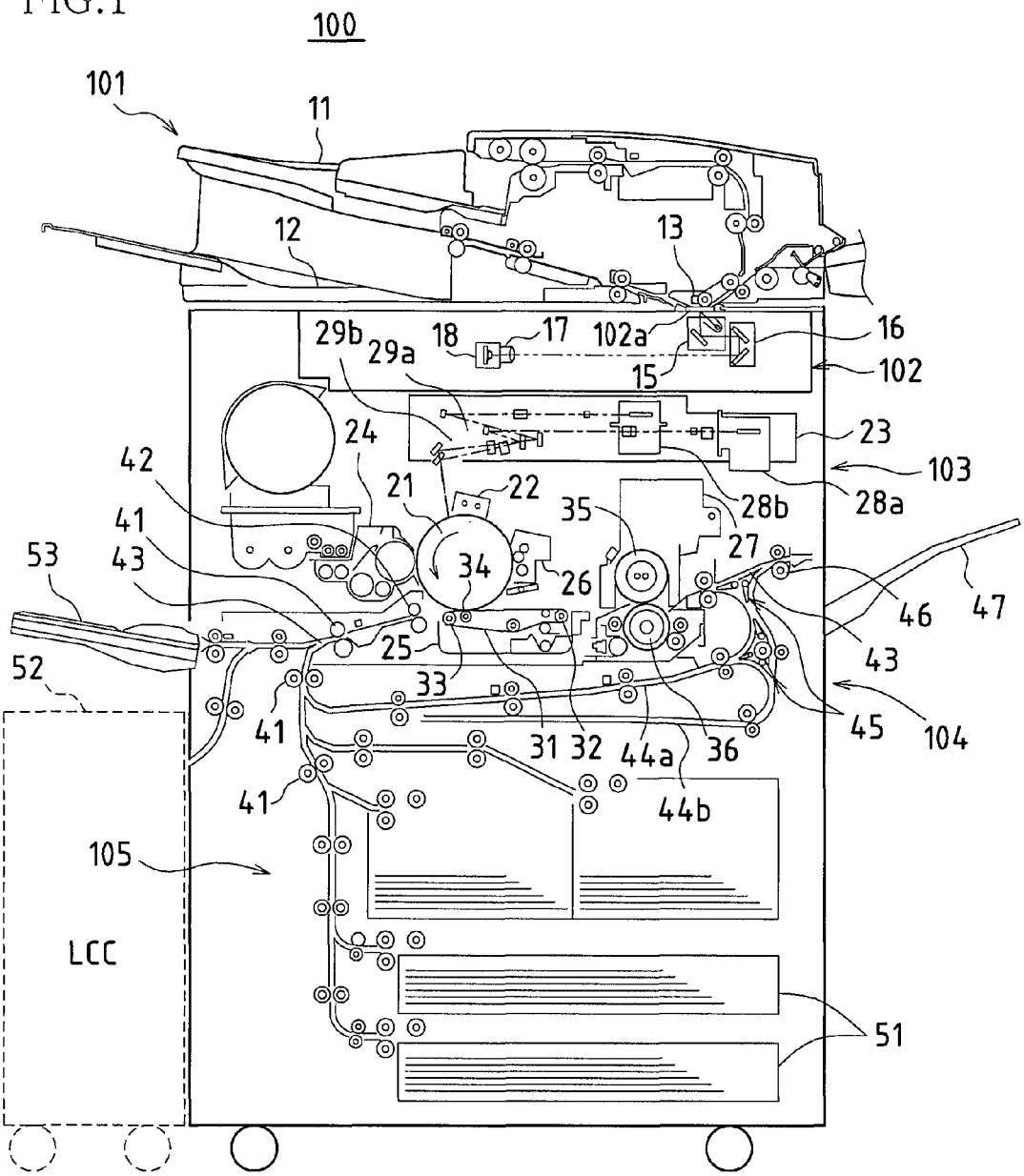
FIG. 1 is a schematic view of an image forming apparatus in which one embodiment of a fixing apparatus according to the present invention has been applied.

FIG. 1 is a schematic view of an image forming apparatus in which one embodiment of a fixing apparatus according to the present invention has been applied.

The image forming apparatus 100 obtains image data that has been read from an original paper or received from outside, and forms a monochrome image indicated by the image data on a recording paper, and its structure can be broadly divided into an original paper transport portion 101, an image reading portion 102, a print portion 103, a recording paper transport portion 104, and a paper feed portion 105.

When at least one sheet of an original paper is set in an original setting tray 11 in the original paper transport portion 101, the original paper is withdrawn and transported from the original setting tray 11 sheet by sheet, and the original paper is guided to and made to pass over an original reading window 102*a* of the image reading portion 102, then the original paper is discharged to a discharge tray 12.

A CIS (contact image sensor) 13 is arranged above the original reading window 102*a*. When the original paper passes over the original reading window 102*a*, the CIS 13 repetitively reads in a main scanning direction an image of a back side of the original paper and outputs image data that indicates an image of the back side of the original paper.

Furthermore, when the original paper passes over the original reading window 102*a*, the image reading portion 102 uses a lamp of a first scanning unit 15 to expose the surface of the original paper, then guides reflected light from the surface of the original paper to an imaging lens 17 using mirrors of the first and a second scanning unit 15 and 16, and an image of the surface of the original paper is imaged onto a CCD (charge coupled device) 18 by the imaging lens 17. The CCD 18 repetitively reads in a main scanning direction an image of the surface of the original paper and outputs image data that indicates an image of the surface of the original paper.

Further still, in a case where the original paper is placed onto a platen glass on an upper surface of the image reading portion 102, the first and second scanning units 15 and 16 are caused to move while maintaining a predetermined velocity relationship such that the surface of the original paper on the platen glass is exposed by the first scanning unit 15 and reflected light from the surface of the original paper is guided to the imaging lens 17 by the first and second scanning units 15 and 16, and an image of the surface of the original paper is imaged onto the CCD 18 by the imaging lens 17.

Image data that has been outputted from the CIS 13 or the CCD 18 undergoes various types of image processing by a control circuit such as a microcomputer and is then outputted to the print portion 103.

The print portion 103 is for recording an original, which is represented by image data, onto paper, and is provided with components such as a photosensitive drum 21, a charging unit 22, an optical writing unit 23, a development unit 24, a transfer unit 25, a cleaning unit 26, and a fixing apparatus 27.

The photosensitive drum 21 rotates in one direction and after its surface is cleaned by the cleaning unit 26, its surface is uniformly charged by the charging unit 22. The charging unit 22 may be a charger type unit or may be a roller type or brush type unit that makes contact with the photosensitive drum 21.

The optical writing unit 23 is a laser scanning unit provided with two laser irradiation portions 28*a* and 28*b*, and two mirror groups 29*a* and 29*b*. The optical writing unit 23 receives image data and emits laser beams corresponding to the image data from the laser irradiation portions 28*a* and 28*b* respectively, then these laser beams are irradiated on the photosensitive drum 21 via the mirror groups 29*a* and 29*b* so that the uniformly charged surface of the photosensitive drum 21 is exposed so as to form an electrostatic latent image on the surface of the photosensitive drum 21.

To support high speed print processing, the optical writing unit 23 employs a two beam system provided with the two laser irradiation portions 28*a* and 28*b* such that the irradiation timing is made faster and the load is decreased.

It should be noted that instead of the laser scanning unit, an EL writing head or an LED writing head in which light-emitting elements are lined up in an array may be used as the optical writing unit 23.

The development unit 24 supplies toner to the surface of the photosensitive drum 21 to develop the electrostatic latent image and form a toner image on the surface of the photosensitive drum 21. The transfer unit 25 transfers the toner image on the surface of the photosensitive drum 21 to the recording paper that has been transported in by the paper transport portion 104. The fixing apparatus 27 applies heat and pressure to the recording paper to cause the toner image to fix onto the recording paper. After this, the recording paper is further transported and discharged to a discharge tray 47 by the paper transport portion 104. Furthermore, the cleaning unit 26 removes and collects toner that is residual on the surface of the photosensitive drum 21 after development and transfer.

Here, the transfer unit 25 is provided with such components as a transfer belt 31, a drive roller 32, an idler roller 33, and an elastic conductive roller 34, and the transfer belt 31 is caused to rotate while spanning the rollers 32 to 34 and other rollers in a tensioned state. The transfer belt 31 has a predetermined resistance value (for example, $1\times10^{9}$ to $1\times10^{13}$ Ω/cm) and transports recording paper that has been placed on its surface. The elastic conductive roller 34 presses against the surface of the photosensitive drum 21 through the transfer belt 31 and the recording paper on the transfer belt 31 presses against the surface of the photosensitive drum 21. An electric field of a polarity opposite to the charge of the toner image on the surface of the photosensitive drum 21 is applied to the elastic conductive roller 34, and the toner image on the surface of the photosensitive drum 21 is transferred to the recording paper on the transfer belt 31 due to the opposite polarity electric field. For example, when the toner image has a charge of a negative (−) polarity, the elastic conductive roller 34 is subjected to an electric field having a positive (+) polarity.

The fixing apparatus 27 is provided a heat roller 35 and a pressure roller 36. A pressure-applying member not shown in the drawings is arranged at both ends of the pressure roller 36 so that the pressure roller 36 is pressed into contact with the heat roller 35 with a predetermined pressure. When the recording paper is transported to a pressing region (referred to as a nip region N1) between the heat roller 35 and the pressure roller 36, the unfixed toner image on the recording paper is subjected to thermal melting and pressure while the recording paper is being transported by the rollers 35 and 36 such that the toner image fixes to the recording paper.

The paper transport portion 104 is provided with components such as a plurality of pairs of transport rollers 41 for transporting the recording paper, a pair of registration rollers 42, a transport path 43, reverse transport paths 44*a* and 44*b*, a plurality of branching claws 45, and a pair of discharge rollers 46.

In the transport path 43, the recording paper is taken in from the paper feed portion 105, then the recording paper is transported until the leading edge of the recording paper reaches the registration rollers 42. At this time the registration rollers 42 are being temporarily stopped, and therefore the leading edge of the recording paper reaches and contacts the registration rollers 42 and the recording paper flexes. Due to the elastic force of the flexed recording paper, the leading edge of the recording paper aligns parallel to the registration rollers 42. After this, rotation of the registration rollers 42 commences and the recording paper is transported by the registration rollers 42 to the transfer unit 25 of the print portion 103, then the recording paper is further transported by the discharge rollers 46 to the discharge tray 47.

Stopping and rotation of the registration rollers 42 can be achieved by switching on and off a clutch between the registration rollers 42 and their drive shafts or by switching on and off the motor that is the drive source of the registration rollers 42.

Furthermore, when an image is to be recorded onto the back side of the recording paper also, the branching claws 45 are selectively switched so that the recording paper is guided from the transport path 43 into the reverse transport path 44*b*, then transport of the recording paper is caused to stop temporarily, and the branching claws 45 are again switched so that the recording paper is guided from the reverse transport path 44*b* into the reverse transport path 44*a*, and once the back side of the recording paper has been turned over the recording paper returns to the registration rollers 42 of the transport path 43 via the reverse transport path 44*a*.

This manner of transporting the recording paper is referred to as switchback transporting, and switchback transporting allows the back side of the recording paper to be turned over and at the same time switches the leading edge and the trailing edge of the recording paper. Consequently, when the recording paper is turned over and returned, the trailing edge of the recording paper makes contact with the registration rollers 42 such that the trailing edge of the recording paper aligns in parallel to the registration rollers 42, then the recording paper is transported from its trailing edge by the registration rollers 42 to the transfer unit 25 of the print portion 103 and printing is carried out on the back side of the recording paper, then the unfixed toner image on the back side of the recording paper is subjected to thermal melting and pressure by the nip region between the rollers 35 and 36 of the fixing apparatus 27 such that the toner image fixes onto the back side of the recording paper, after which the recording paper is transported to the discharge tray 47 by the discharge rollers 46.

Sensors that detect the position and the like of the recording paper are arranged in various locations in the transport path 43 and the reverse transport paths 44*a* and 44*b*, and the transport and positioning of the recording paper are carried out by drive controlling the transport rollers and the registration rollers based on the positions of the recording paper detected by the various sensors.

The paper feed portion 105 is provided with a plurality of paper feed trays 51. Each of the paper feed trays 51 is a tray for storing recording paper and these are provided below the image forming apparatus 100. Furthermore, each of the paper feed trays 51 is provided with a pickup roller or the like for withdrawing the recording paper sheet by sheet, and recording paper that has been withdrawn is fed to the transport path 43 of the paper transport portion 104.

Since the image forming apparatus 100 is aimed at high speed print processing, each of the paper feed trays 51 has a capacity capable of storing from 500 to 1,500 sheets of standard size recording papers.

Furthermore, at a lateral surface of the image forming apparatus 100 are provided a large capacity cassette (LCC) 52, which makes it possible to store large volumes of multiple types of recording paper, and a manual paper feed tray 53 for supplying recording paper of mainly nonstandard sizes.

The discharge tray 47 is arranged at a lateral surface of an opposite side to the manual paper feed tray 53. Instead of the discharge tray 47, configurations in which post processing devices of the recording paper (stapling, punching and the like) or a plurality of levels of discharge trays are arranged as options are also possible.

In the image forming apparatus 100 as above, the print processing speed is increased to improve the usefulness thereof. For example, when using standard A4 size recording paper, the transport speed of the recording paper is set to 110 sheets/min (a processing speed of 540 mm/sec).

When the transport speed or the processing speed of the recording paper is increased in the fixing apparatus 27, there is a tendency for a sufficient amount of heat to become unable to be applied to the recording paper that passes through the nip region between the heat roller 35 and the pressure roller 36, and for the surface temperature of the rollers 35 and 36 to drop, and if this is ignored, deficiencies occur in the fixing of the toner image to the recording paper.

For this reason, in the fixing apparatus 27, a heater is installed internally to both the rollers 35 and 36 and the rollers 35 and 36 are heated.

Figure 2:
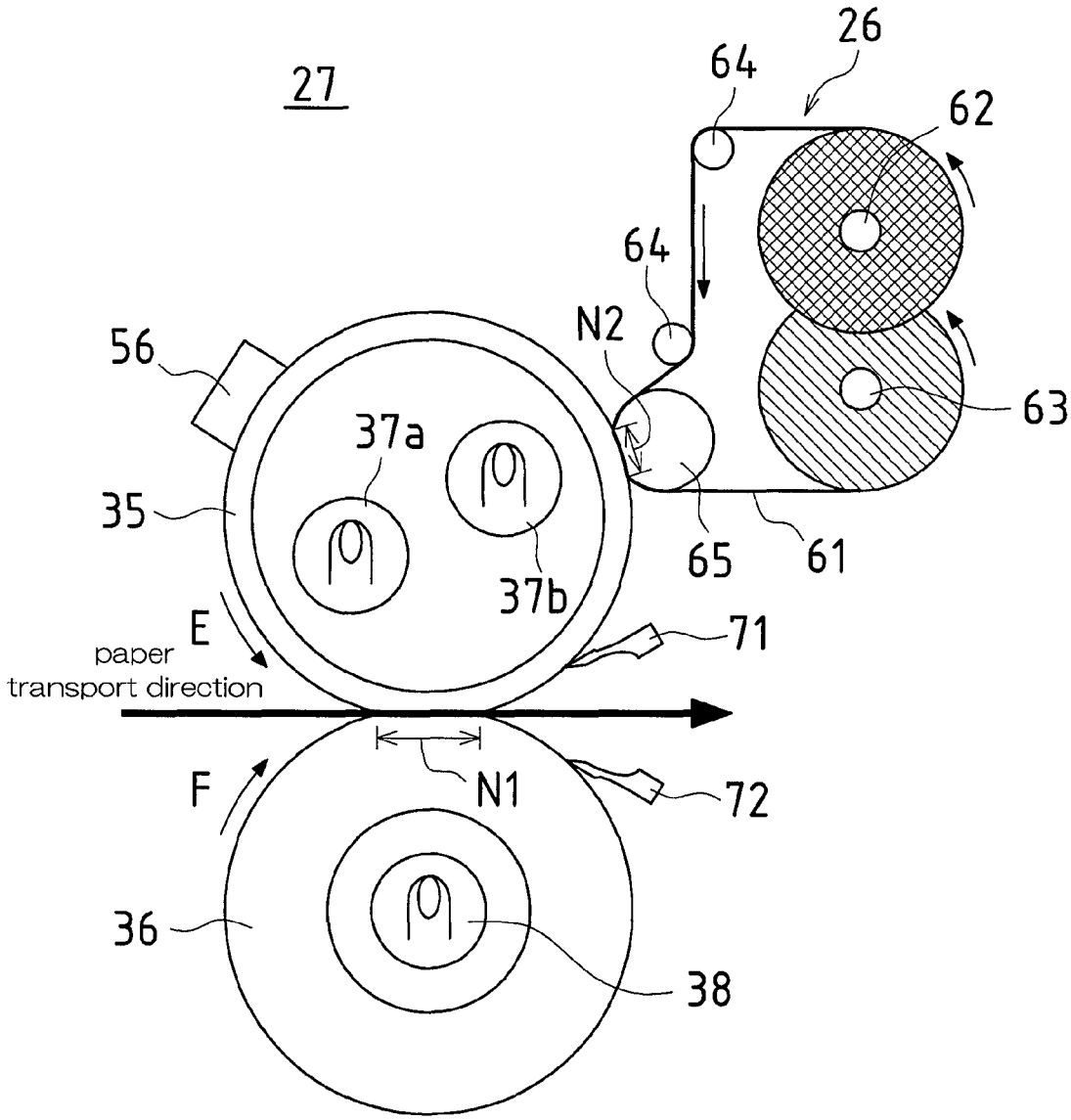
FIG. 2 is a cross-sectional view that schematically illustrates the fixing apparatus as viewed laterally.

FIG. 2 is a cross-sectional view that schematically illustrates the fixing apparatus 27 as viewed laterally. The fixing apparatus 27 is provided with the heat roller 35, the pressure roller 36, the cleaning unit 26 for removing toner that has adhered to the surface of the heat roller 35, and separation claws 71 and 72 respectively provided at a surface of the rollers 35 and 36.

The cleaning unit 26 is provided with a feed-out roller 62 onto which is wound a web sheet 61 constituted by a thin cloth (approximately 40 μm thick) impregnated with an oil (silicone oil), a take-up roller 63 to which the leading edge of the web sheet 61 is connected, a plurality of tension rollers 64 that apply tension to the web sheet 61 along the transport path of the web sheet 61 from the feed-out roller 62 to the take-up roller 63, and a pressing roller 65 that presses the web sheet 61 between the feed-out roller 62 and the take-up roller 63 onto the heat roller 35, and residual toner sticking to the surface of the heat roller 35 is wiped off and removed by the web sheet 61 being pressed against the surface of the heat roller 35 by the pressing roller 65.

The web sheet 61 is pressed against the surface of the heat roller 35 by the pressing roller 65 at a nip region N2 between the pressing roller 65 and the heat roller 35. A portion of the web sheet 61 at the nip region N2 becomes smeared by residual toner on the surface of the heat roller 35, and when removal of residual toner by this portion of the web sheet 61 becomes difficult, the feed-out roller 62 and the take-up roller 63 are rotated by a fixed amount so that the web sheet 61 is fed out from the feed-out roller 62 to the take-up roller 63 by a fixed amount, thereby renewing the portion of the web sheet 61 at the nip region and making it possible to remove residual toner with this new portion of the web sheet 61. In this way, the portion of the web sheet 61 at the nip region N2 is renewed, and removal of residual toner by the new portion of the web sheet 61 is made possible.

Furthermore, when for each time a fixed amount of toner is consumed and it is deemed that removal of residual toner by the portion of the web sheet 61 of the nip region N2 has become difficult, the feed-out roller 62 and the take-up roller 63 are rotated by a fixed amount to renew the portion of the web sheet 61 at the nip region N2. Consequently, the feed-out roller 62 and the take-up roller 63 are intermittently rotationally driven.

It should be noted that although toner also sticks to the surface of the pressure roller 36, the toner on the surface of the pressure roller 36 moves to the surface of the heat roller 35 at the nip region N1, after which it is removed by the cleaning unit 26.

Next, the separation claws 71 and 72 are arranged on a downstream side from the nip region N1 in the rotation direction of the rollers 35 and 36. The separation claws 71 and 72 are swingably or elastically supported near their base ends, and the leading edge side of the separation claws 71 and 72 apply a biasing force due to their elastic members against the rollers 35 and 36 respectively such that the leading edge vicinity of each of the separation claws 71 and 72 presses lightly against the surface of the rollers 35 and 36 respectively. When a recording paper is wound onto either of the rollers 35 and 36, the leading edge of the recording paper is separated by the leading edge of either of the separation claws 71 and 72 and the recording paper is peeled off from the roller surface. In this way, jamming of the recording paper is prevented.

The rollers 35 and 36 press against each other with a predetermined pressing force (for example, 600 N) and the nip region N1 is formed between these. The length of the nip region N1 (the length along the rotation direction of the rollers 35 and 36) is set to 9 mm for example. The rollers 35 and 36 rotate while being heated to a prescribed fixing temperature (for example 180° C.) and a toner image on a recording paper P that passes through the nip region N1 is thermally melted.

The heat roller 35 is a roller having a three-layer structure in which an elastic layer is provided on an outer surface of its core and a mold release layer is formed on an outer surface of the elastic layer. A metal such as iron, stainless steel, aluminum, or copper for example, or an alloy of these or the like, is used for the core. Furthermore, a silicone rubber is used for the elastic layer, and a fluorocarbon resin such as PFA (a copolymer of tetrafluoroethylene and perfluoroalkyl vinyl ether) and PTFE (polytetrafluoroethylene) is used for the mold release layer.

Two halogen heaters 37*a* and 37*b*, which are heat sources for heating the roller 35, are provided inside the heat roller 35 (inside the core).

Like the heat roller 35, the pressure roller 36 is also a roller having a three-layer structure that is constituted by a core of a metal such as iron, stainless steel, aluminum, or copper or an alloy of any of these, an elastic layer of a silicone rubber or the like on a surface of the core, and further still a mold release layer thereon of PFA or PTFE or the like. And a halogen heater 38 for heating the roller 36 is also provided inside the pressure roller 36 (inside the core).

Furthermore, a thermistor 56 is arranged near the surface of the heat roller 35 and the surface temperature of the heat roller 35 is detected by the thermistor 56.

Here, the shaft of the heat roller 35 is rotationally driven by a motor and a power transmission mechanism or the like (not shown in drawings) and rotates in a direction indicated by arrow E. Due to being in contact with the heat roller 35, the pressure roller 36 is idly rotated in a direction indicated by arrow F.

Furthermore, the halogen heaters 37*a*, 37*b*, and 38 of the heat roller 35 and the pressure roller 36 are controlled based on the surface temperature of the heat roller 35 detected by the thermistor 56 so as to regulate the surface temperatures of the heat roller 35 and the pressure roller 36. In this way, the surface temperatures of the rollers 35 and 36 are controlled appropriately and the toner image on the recording paper can be fixed reliably.

In the fixing apparatus 27 of the above-described configuration, the recording paper that has wound onto the heat roller 35 is forcibly peeled off by the separation claw 71, but at the time the paper is forcibly peeled off by the separation claw 71 the melted toner that is adhering onto the heat roller 35 adheres to the separation claw 71. The melted toner adhering to the separation claw 71, when a certain amount of it has accumulated on the separation claw 71, separates from the separation claw 71, moves in reverse to the heat roller 35, reaches the cleaning unit 26, and is collected by the cleaning unit 26.

However, when the speed of the image forming apparatus has been increased and the print processing sheet number becomes large volume, the amount of melted toner that separates from the separation claw 71 also becomes large volume, and there is a problem that it escapes past the web sheet 61 of the cleaning unit 26. Consequently, not only does the cleaning of the heat roller 35 become incomplete, toner also moves to the pressure roller 36 at the nip region N1 and becomes a cause of smearing on the back side of the recording paper that is transported in for the next printing process.

Accordingly, in the present embodiment, the following technique is employed in order to address the above-described problem of toner that has separated from the separation claw 71 escaping past the web sheet 61 of the cleaning unit 26. That is, in the fixing apparatus 27 of the present embodiment, a predetermined period different from the fixing process period in which fixing of the toner onto the recording sheet is carried out is set as a toner removal period, and during this toner removal period, drive control is carried out so that the heat roller 35 and the pressure roller 36 are rotated at a low speed. In this case, as described earlier, the separation claw 71 is swingably or elastically supported near its base, and due to its elastic member, the leading edge side of the separation claw 71 is biased to the roller 35, and therefore by causing the heat roller 35 to rotate at low speed, the separation claw 71 vibrates such that the toner adhering to the separation claw 71 tends to separate from it easily. In other words, separation of the toner from the separation claw 71 is promoted by slowing the rotation velocity of the heat roller 35 and the cleaning time for the surface of the heat roller 35 is lengthened by lengthening the time in which the toner, which has separated and moved in reverse on the heat roller 35, passes through the pressing area (nip region N2) between the heat roller 35 and the web sheet 61, thereby achieving improved cleaning efficiency.

Hereinafter description is given concerning a drive control method for a fixing apparatus according to the present embodiment, but before that, description is given here concerning a conventional drive control method for the purpose of comparison.

—Description of Conventional Drive Control Method—

Figure 3:
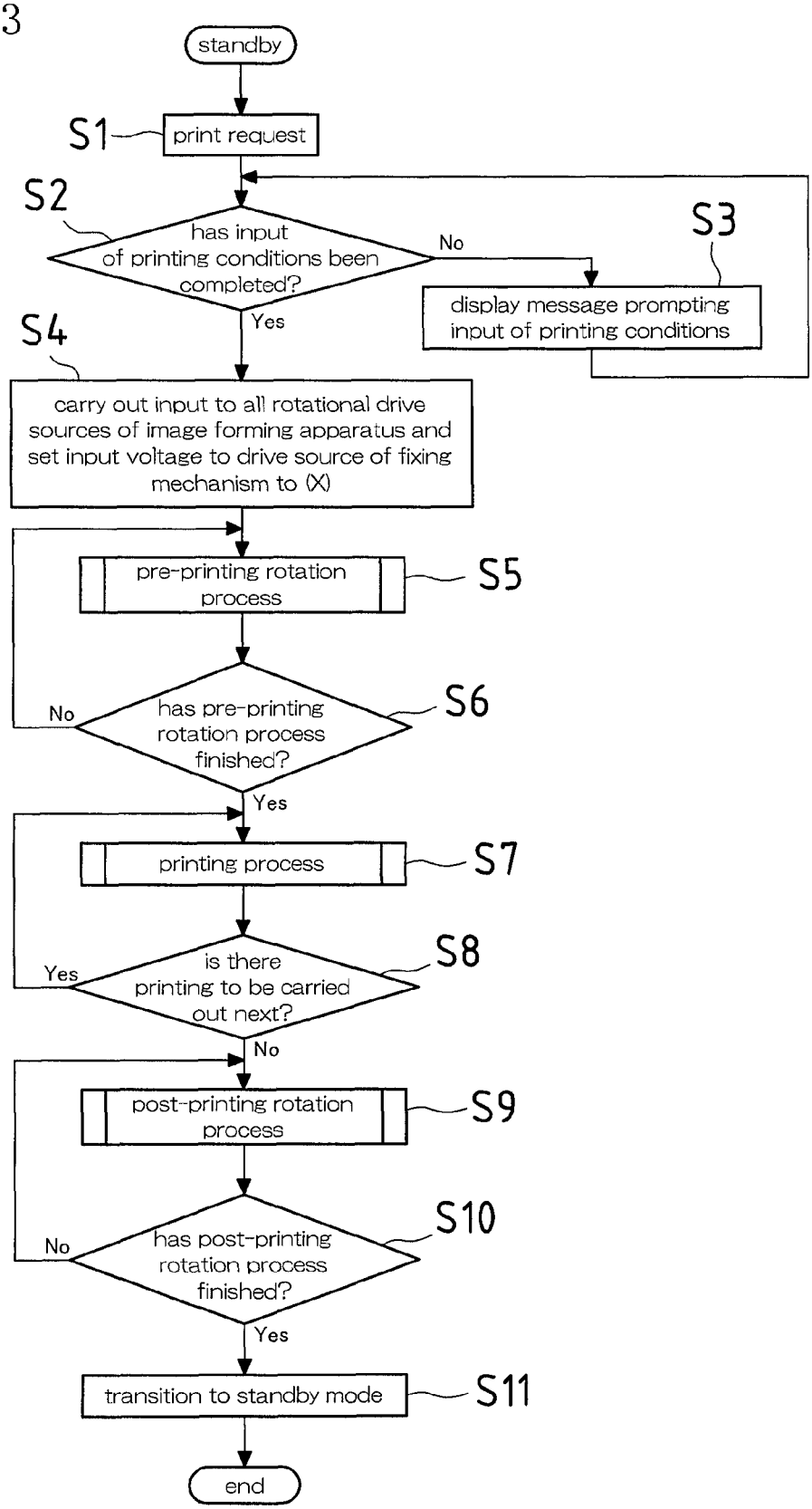
FIG. 3 is a flowchart for describing a conventional drive control method.
Figure 4:
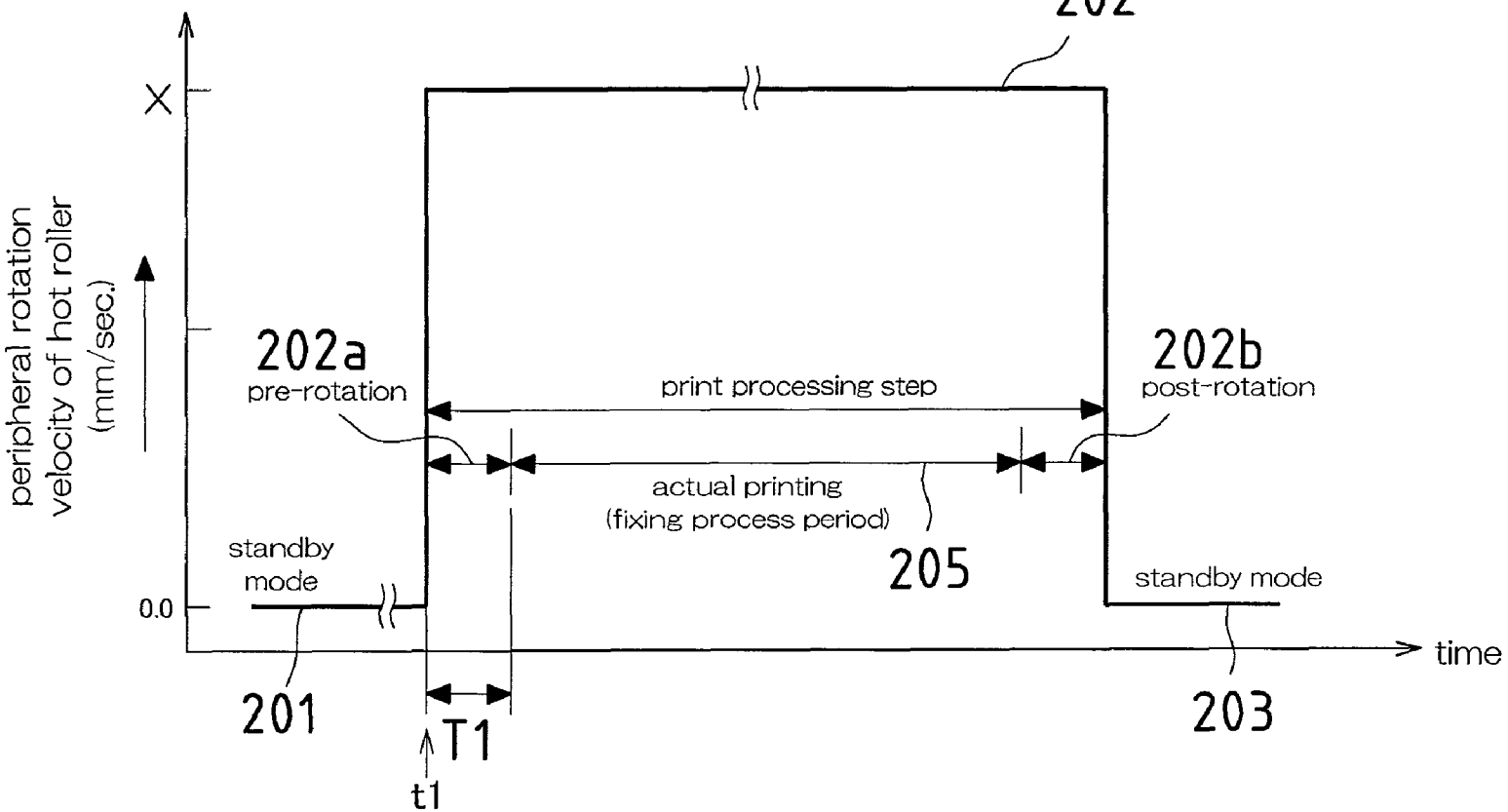
FIG. 4 is a timing chart for describing a conventional drive control method.

FIG. 3 is flowchart for describing a conventional drive control method and FIG. 4 is a timing chart.

Before a print request, an image forming apparatus is ordinarily in a standby mode, and all the rotational drive source portions are in an off state. Accordingly, as shown in FIG. 4, the fixing apparatus 27 is also in a standby mode 201 before a print request (before a time t1). On the other hand, a peripheral rotation velocity (X) of the heat roller 35 during a print processing step 202 is set to [(print processing speed)×(1.005 to 1.03)] so that the recording paper is not detained in the fixing apparatus 27, and the heat roller is usually always rotating at this fixed velocity (X).

When there is a print request (time t1) to the image forming apparatus during standby (step S1), an unshown control portion of the image forming apparatus (hereinafter simply referred to as "control portion") confirms whether or not input of print processing conditions has been completed (step S2), then when the input has not been completed (when determined "No" at step S2), a message prompting this input is displayed on an unshown display portion (step S3). On the other hand, when input of the print processing conditions has been completed, a transition is made from the standby mode 201 to the print processing step 202 and an operation for print processing commences. That is, input is carried out to all the rotational drive sources of the image forming apparatus. At this time, the control portion performs control of the input voltage to the rotational drive sources of the fixing apparatus 27 (note that this is when the drives sources are DC motors) so that the peripheral rotation velocity of the heat roller 35 becomes X (step S4).

Next, in order for the image forming apparatus, in which input of the input conditions has been completed and the input voltage to the rotational drive sources of the fixing apparatus 27 has been determined, to carry out initialization of the portions inside the apparatus to be used in print processing, a pre-printing rotation process 202*a* is carried out (step S5). A time T1 of the pre-printing rotation process is ordinarily a time in which the photosensitive drum 21 rotates at least one rotation or more. In this process, steps are carried out such as initialization of the each sensor in the apparatus, charge removal of the surface electric potential residing on the photosensitive drum 21, cleaning of residual toner on the photosensitive drum 21, cleaning of the rollers 35 and 36 of the fixing apparatus 27, determining whether or not the surface temperature of the heat roller 35 has reached the set fixing temperature, and moreover determining whether or not any paper is detained in the paper transport paths of the image forming apparatus.

When the pre-printing rotation process 202*a* is finished (when determined "Yes" at step S6), the control portion carries out the printing process (step S7) in which the image information for which a print request has been made is made into a manifest image on the recording paper in a transfer step of the photosensitive drum 21. Then, when printing is finished and the recording paper that has passed through the fixing apparatus 27 is discharged to the discharge tray 47, the control portion confirms whether or not there is printing to be carried out next (step S8), and when there is printing to be carried out next (when determined "Yes" at step S8), the next print processing is carried out (step S7).

On the other hand, when all the printing of the image information for which a print request has been made is finished (when determined "No" at step S8), the control portion executes a post-printing rotation process 202*b* in a same manner as the earlier pre-printing rotation process 202*a* (step S9). Here, "post-printing" refers to after the trailing edge of the final paper for the print request has passed through the nip region N1. Then, when the post-printing rotation process 202*b* is finished (when determined "Yes" at step S10), a transition is made again to the standby mode 203 (step S11). That is, all the rotational drive sources are stopped and only surface temperature control is operated for the heat roller 35. The above has been a description of the drive control method for a conventional image forming apparatus.

—Description of Drive Control Method of Present Embodiment—

Figure 5:
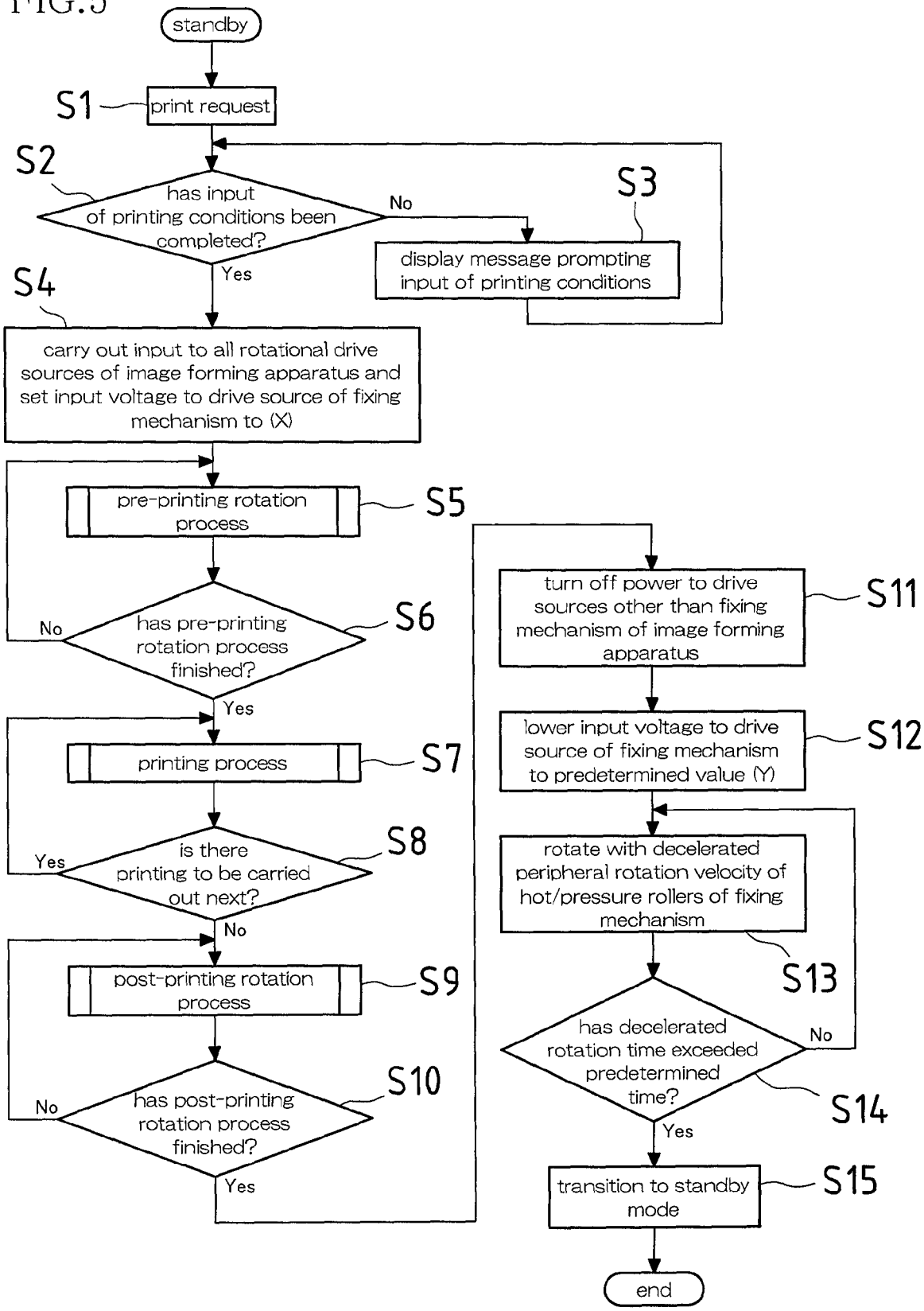
FIG. 5 is a flowchart for describing a drive control method according to the present invention.
Figure 6:
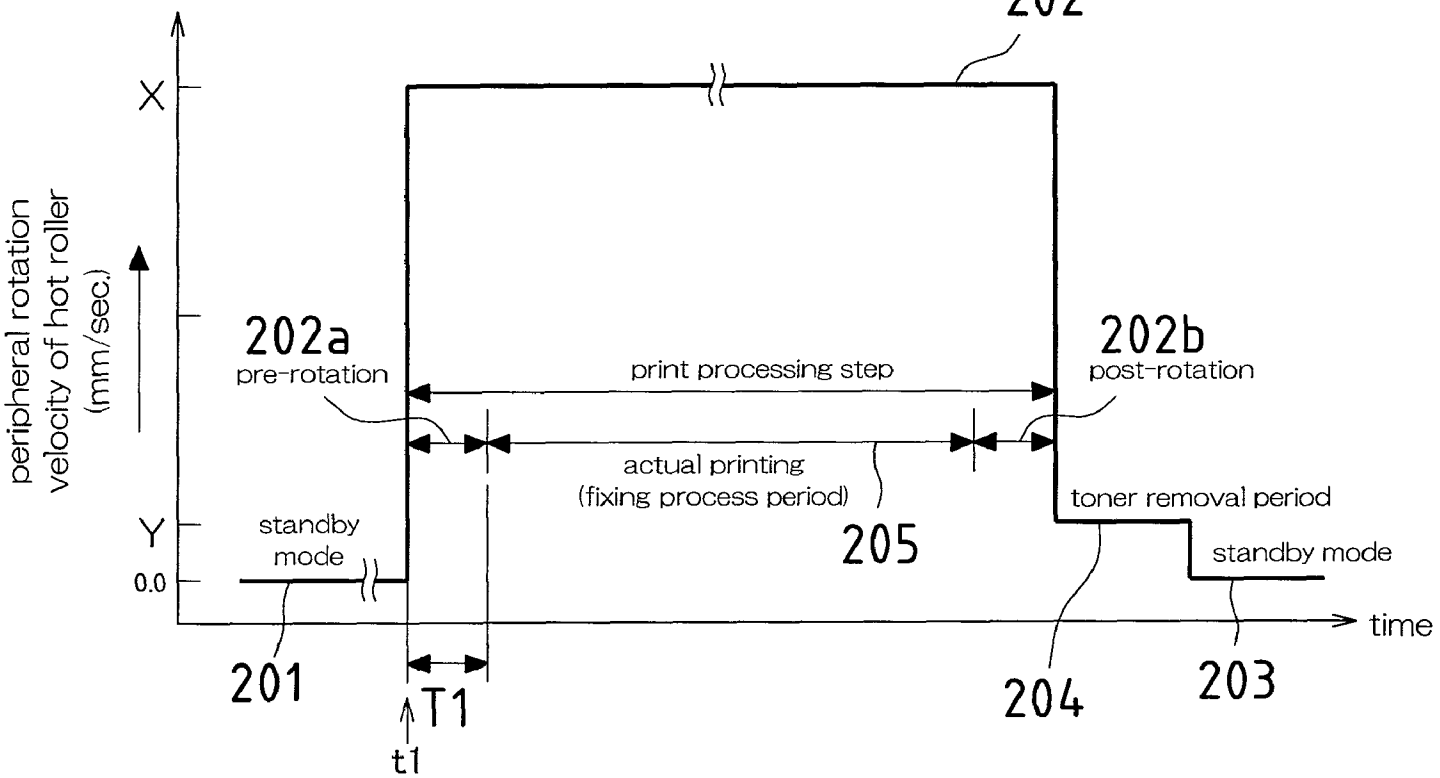
FIG. 6 is a timing chart for describing a drive control method according to the present invention.

FIG. 5 is flowchart for describing a drive control method according to the present embodiment and FIG. 6 is a timing chart. Note that in the present embodiment, the processes from step S1 to step S10 in FIG. 5 are identical to the processes of the conventional drive control method shown in FIG. 3, and therefore description is given here from step S11 onward.

When all the printing of image information for which a print request has been made finishes and the post-printing rotation process 202*b* has finished (when determined "Yes" at step S10), the control portion stops the power to rotational drive sources other than the fixing apparatus 27 in the same manner as conventionally, but maintains the power to the rotational drive source of the fixing apparatus 27. At this time, the control portion performs control on the input power to the rotational drive source (DC motor) so that the rotational control of the heat roller 35 achieves a sufficiently decelerated peripheral rotation velocity (Y) compared to the above-described fixed peripheral rotation velocity (X) as shown in FIG. 6 (step S11 and step S12). Detailed description is given in regard to the peripheral rotation velocity (Y) in a later section "Examining Deceleration Ratios of the Heat roller."

Then, rotational control of a toner removal period 204 is carried out while the peripheral rotation velocity of the heat roller 35 has been decelerated to Y (step S13), and after the toner removal period 204 has elapsed, the power to the rotational drive source of the fixing apparatus 27 is turned off (step S14), and a transition is made to the standby mode 203 in the same manner as conventionally (step S15).

Here, it is suitable for the toner removal period 204 to be a time in which the heat roller 35 performs at least two rotations or more, and more preferably a time in which it performs four rotations. When the toner removal period 204 is short, there is a possibility that toner adhering to the heat roller 35 or the pressure roller 36 will not be removed by the cleaning unit 26 and become residual as described above in regard to means for addressing this problem. On the other hand, although improved cleaning efficiency is achieved by carrying out a long period of rotation driving for the toner removal period 204, this involves wasted rotation driving and delays the timing of the transition to the standby mode 203 (or a power conserving mode or a power saving mode or the like), and is an inefficient form of control in terms of power conservation.

Figure 7:
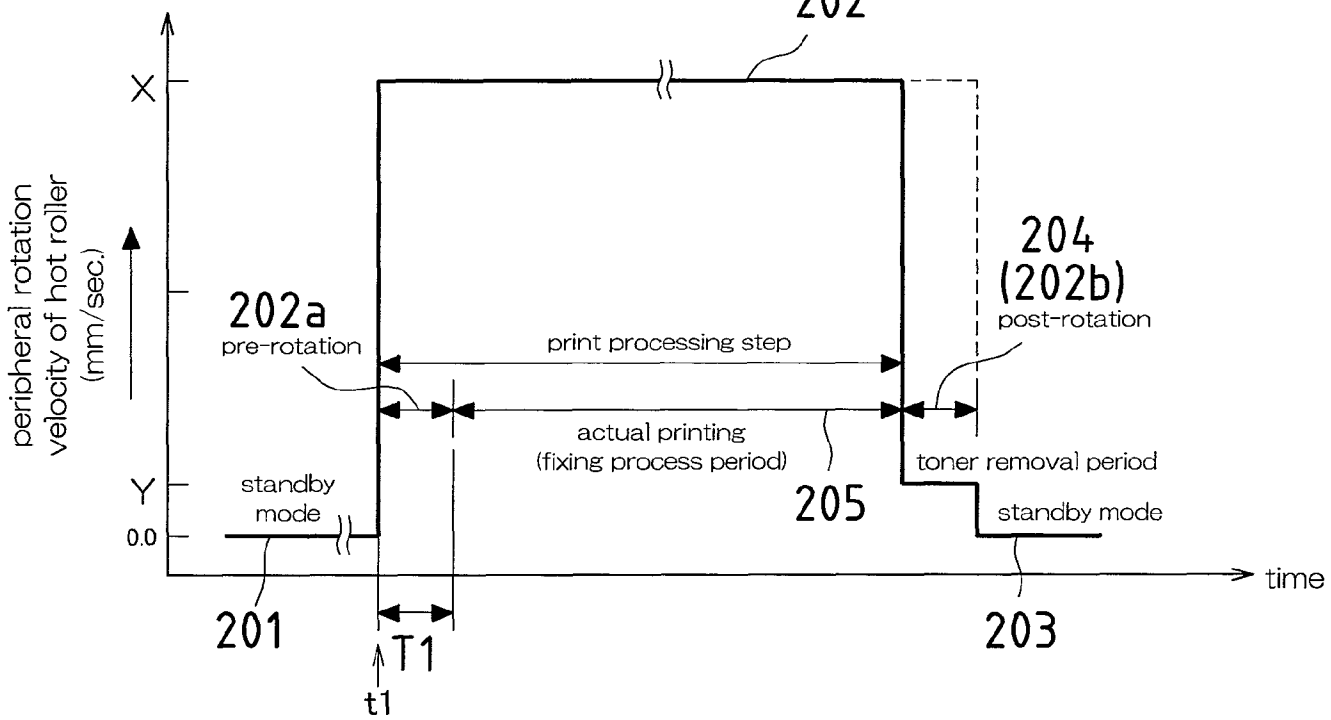
FIG. 7 is a timing chart for describing a different drive control method according to the present invention.
Figure 8:
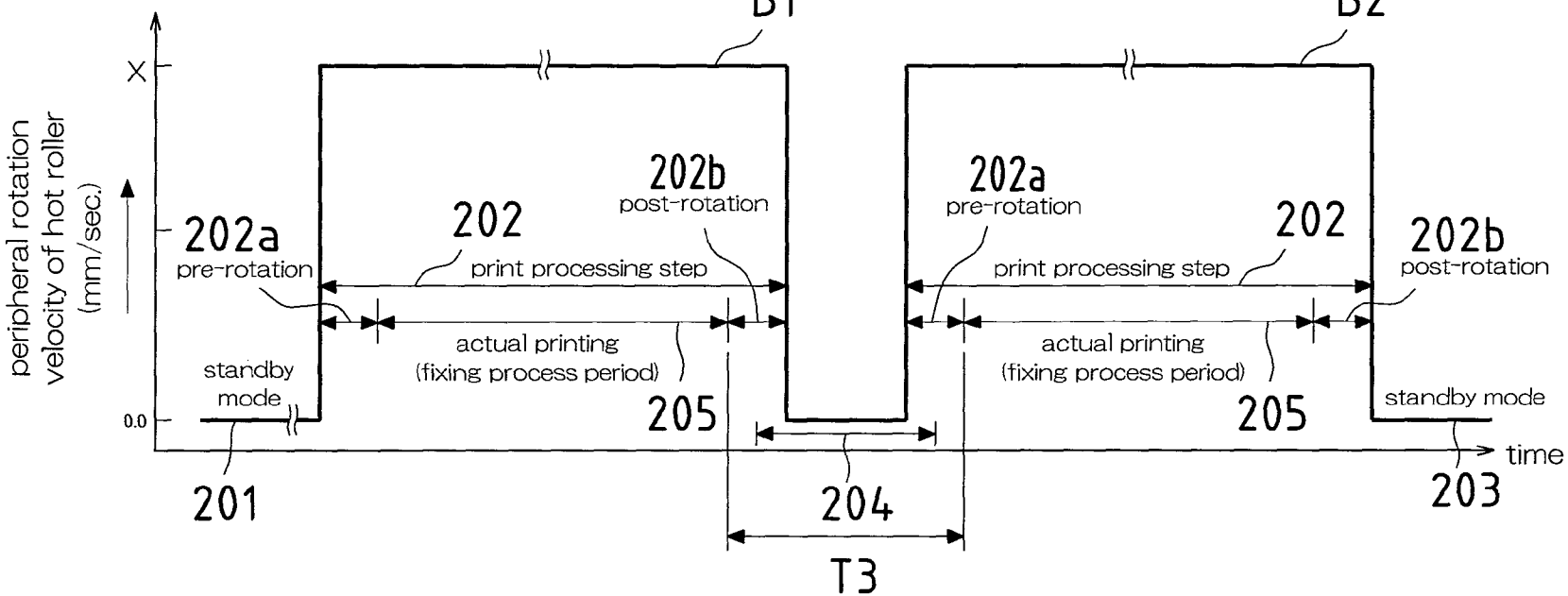
FIG. 8 is a timing chart for describing another different drive control method according to the present invention.

It should be noted that the above-described embodiment was illustrated using an example of a drive control method in which the toner removal period 204 is executed following the completion of the post-printing rotation process 202*b* of the print processing step 202, but it is also possible to execute the toner removal period 204 at the time of the post-printing rotation process 202*b* immediately after the completion of a single print job as shown in FIG. 7. This is effective when print requests are made successively to the image forming apparatus. Furthermore, in consideration of cases where print requests are made successively to the image forming apparatus, the timing of the transition to the toner removal period 204 may be set to an arbitrary timing during an idle rotation period between print request jobs made to the image forming apparatus as shown in FIG. 8, specifically, a period T3 from commencement of the post-printing rotation process 202*b* of a print request job B1 until completion of the pre-printing rotation process 202*a* of a next print request job B2. By using a timing such as this, it is possible to set the toner removal period 204 without exerting an influence on the fixing process period 205.

—Examining Deceleration Ratios of the Heat Roller—

Next, deceleration ratios (relationships of X and Y) of the heat roller 35 are examined.

FIG. 9 shows results of evaluating smearing (Table 1) when the heat roller 35 was continuously rotated at various peripheral rotation velocities, and FIG. 10 shows results of evaluating smearing (Table 2) when the heat roller 35 was rotated at various peripheral rotation velocities and rotated intermittently with various on-off times (the rotational drive source in this case is a pulse motor).

To describe this more specifically, Table 1 shows results of seven settings for the continuous peripheral rotation velocity (mm/sec) of the heat roller 35, namely 540, 178, 128, 85, 57, 42, and 28 mm/sec and evaluations of smearing when the toner removal period was executed at these velocities.

Furthermore, Table 2 shows results of executing 50 times and 70 times as two types of number of times of on-off repetitions of the drive source, as well as executing 20 msec, 30 msec, and 50 msec as three types of on times and also using 100 msec, 200 msec, and 500 msec as three types of off times in combination with the 20 msec and 30 msec on times, and executing eight velocity settings for the peripheral rotation velocity (mm/sec) of the heat roller 35, namely 110, 44, 55, 147, 95, 114, 134, and 183 mm/sec, for each of these combinations, and evaluating smearing for these respectively. It should be noted that results of evaluating smearing when performing continuous rotation at a peripheral rotation velocity of 557 (mm/sec) are also shown in the lowest cells. For example, "x" is shown as a smearing evaluation when the peripheral rotation velocity is set to 110 mm/sec, and intermittent rotation is repeated 70 times with an on time of 20 msec and an off time of 100 msec.

Here description is given concerning a manner of understanding the smearing evaluations. In the smearing evaluations, "x" indicates bad, "xx" indicates quite bad, "xxx" indicates worst, "Δ" indicates somewhat good, "○" indicates good, and "◎" indicates extremely good. Here, evaluations from "x" to "xxx" are evaluations of when there is irregular accumulation on the web sheet 61, smearing on the heat roller 35, and a state which in smearing to the back side of the recording paper is progressively increasing. Furthermore, the evaluation of "Δ" is an evaluation of when there is irregular accumulation on the web sheet 61, smearing on the heat roller 35, but in which there is no smearing to the back side of the recording paper. Furthermore, the evaluation of "○" is an evaluation of when there is slight irregular accumulation on the web sheet 61, but no smearing on the heat roller 35 and no smearing to the back side of the recording paper. Furthermore, the evaluation of "◎" is an evaluation of when there is no irregular accumulation on the web sheet 61, no smearing on the heat roller 35, and no smearing to the back side of the recording paper.

It should be noted that conditions for the evaluation testing in Table 1 and Table 2 were heat roller diameter: 70 mm, pressure roller diameter: 60 mm, web sheet thickness: 40 μm, $SiO_2$ oil impregnation amount: 15 $gm^2$, web sheet nip width: 5 mm, and pressing force on web sheet: 4 kg.

There is no evaluation of "◎," in which there is no occurrence of either smearing on the heat roller or smearing to the back side of the recording paper in the evaluation results for the case of intermittent rotation in Table 2, but there is an evaluation of "◎" in the evaluation results for the case of continuous rotation in Table 1. From this it is evident in regard to the rotation drive control of the heat roller in the toner removal period that better cleaning results are obtainable for driving with continuous rotation than for driving with intermittent rotation of the heat roller.

Further still, in Table 1 it is evident that the cleaning efficiency is better for slower peripheral rotation velocities of the heat roller during continuous rotation, and from the test results, very reliable cleaning can be achieved for large amounts of adhered toner that has separated from the separation claws 71 and 72 and subjected to reverse movement on the heat roller 35 when the peripheral rotation velocity of the heat roller 35 is decelerated below 42 mm/sec. In this testing, the processing speed in the print processing step (print processing speed) was set to 540 mm/sec, and therefore it is evident that as long as generally [(print processing speed): (cleaning speed)=10:1] or less is the case, then it is a level at which a sufficient cleaning capability can be satisfied. However, when the peripheral rotation velocity of the heat roller 35 is excessively decelerated, the heat roller 35 begins to rotate intermittently depending on conditions (variable range of input voltage and input pulse range) of the motor (DC motor, pulse motor or the like) used as the rotational drive source of the fixing apparatus 27, thereby obtaining the same results as in Table 2, so that it is necessary to perform low speed control giving sufficient consideration to the characteristics of the motor being used.

Accordingly, in light of the results of Table 1, the peripheral rotation velocity (Y) of the heat roller 35 in the toner removal period can be set to a peripheral rotation velocity of 1/19 to 1/10 times the peripheral rotation velocity (X=540 mm/sec) of the heat roller 35 in the fixing process period. Here, a peripheral rotation velocity of 1/19 is approximately a velocity of 28 mm/sec, and a peripheral rotation velocity of 1/10 is a velocity of 54 mm/sec.

The present invention can be embodied and practiced in other different forms without departing from the spirit and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A roller drive control method for a fixing apparatus in which a separation claw for separating a recording paper and a cleaning unit for removing toner that has become residual on a surface of a heat roller are arranged near a surface of the heat roller that fixes toner onto the recording paper, wherein a predetermined period different from a fixing process period in which fixing of toner onto the recording paper is carried out is set as a toner removal period for removing toner that has adhered to the separation claw by using the cleaning unit and via the heat roller, and the heat roller is rotationally driven without suspension during the toner removal period so that a peripheral velocity of the heat roller in the toner removal period is a peripheral velocity 1/19 to 1/10 times the peripheral velocity of the heat roller in the fixing process period.

2. The roller drive control method for a fixing apparatus according to claim 1, wherein the cleaning unit uses a web sheet.

3. The roller drive control method for a fixing apparatus according to claim 1, wherein a peripheral velocity of the heat roller in the fixing process period is 1.005 to 1.03 times faster than a print processing velocity of an image forming apparatus.

4. The roller drive control method for a fixing apparatus according to claim 1, wherein the toner removal period is a period in which the heat roller performs at least two rotations or more.

5. The roller drive control method for a fixing apparatus according to claim 1, wherein the toner removal period is a period in which the heat roller performs four rotations.

6. The roller drive control method for a fixing apparatus according to claim 1, wherein a timing of a transition to the toner removal period is a timing by which a standby mode commences immediately after completion of print requests to the image forming apparatus.

7. The roller drive control method for a fixing apparatus according to claim 6, wherein after the toner removal period has finished, power to a rotational drive source of the heat roller is turned off by the image forming apparatus changing to a standby mode.

8. The roller drive control method for a fixing apparatus according to claim 1, wherein a timing of a transition to the toner removal period is a timing during a post-printing rotation process after a trailing edge of a final paper of print requests made to the image forming apparatus has passed through a pressing area between the heat roller and a pressure roller.

9. The roller drive control method for a fixing apparatus according to claim 8, wherein after the toner removal period has finished, power to a rotational drive source of the heat roller is turned off by the image forming apparatus changing to a standby mode.

10. The roller drive control method for a fixing apparatus according to claim 1, wherein a timing of a transition to the toner removal period when print request jobs are made successively to the image forming apparatus is set to an arbitrary timing during an idle rotation period between print request jobs made to the image forming apparatus or a period from commencement of a post-printing rotation process of a print request job until completion of a pre-printing rotation process of a next print request job.

11. The roller drive control method for a fixing apparatus according to claim 1, wherein rotation velocity control of the heat roller is controlled by a magnitude of power given to a rotational drive source.

12. The roller drive control method for a fixing apparatus according to claim 1, wherein rotation velocity control of the heat roller is controlled by increasing or decreasing a number of pulses of power given to a rotational drive source.

13. A roller drive control method for a fixing apparatus in which a separation claw for separating a recording paper and a cleaning unit for removing toner that has become residual on a surface of a heat roller are arranged near a surface of the heat roller that fixes toner onto the recording paper, wherein a predetermined period different from a fixing process period in which fixing of toner onto the recording paper is carried out is set as a toner removal period for removing toner that has adhered to the separation claw by using the cleaning unit and via the heat roller, and the heat roller is rotationally driven without suspension during the toner removal period so that a peripheral velocity of the heat roller in the toner removal period is a peripheral velocity of not less than 28 mm/sec and of not more than 54 mm/sec.

* * * * *